United States Patent [19]

Volcovici

[11] 4,371,761

[45] Feb. 1, 1983

[54] ELECTRIC DISPATCHERS

[76] Inventor: David Volcovici, 65-45 Yellowstone Blvd., #1B/T2, Forest Hills, N.Y. 11375

[21] Appl. No.: 244,279

[22] Filed: Mar. 16, 1981

Related U.S. Application Data

[63] Continuation-in-part of Ser. No. 925,986, Jul. 19, 1978, abandoned, which is a continuation of Ser. No. 780,057, Mar. 22, 1977, abandoned.

[51] Int. Cl.[3] ..... H01H 7/00; H01H 19/00; H01H 43/00

[52] U.S. Cl. ..... 200/27 BA; 200/36; 200/37 R

[58] Field of Search ..... 200/27 B, 27 BA, 23, 200/24, 28, 36, 37 R, 37 A, 35 R; 335/306

[56] References Cited

U.S. PATENT DOCUMENTS

| | | | |
|---|---|---|---|
| 2,165,444 | 7/1939 | Bissell | 200/27 BA |
| 2,932,702 | 4/1960 | Greene et al. | 200/36 |
| 2,937,246 | 5/1960 | Bothwell | 200/37 A X |
| 3,189,697 | 6/1965 | Holzer | 200/27 B X |
| 3,281,734 | 10/1966 | Ansley | 335/206 |
| 3,710,045 | 1/1973 | Jochim | 200/37 R |
| 3,752,943 | 8/1973 | Wang | 200/37 A |
| 4,004,408 | 1/1977 | Siefert et al. | 200/37 R X |

*Primary Examiner*—J. R. Scott

[57] ABSTRACT

An Electric Dispatcher switching system is actuated by an electric clock mechanism and is designed to set in motion automatically, either simultaneously or consecutively, and to stop in the same way, a number of electric appliances or machines. The Electric Dispatcher comprises concentric circles of connecting structure energized by the rotating commutator arm of an electric clock having permanent magnets or gliders fixed on the commutator arm. Electric current is distributed through the connector structure to an electric wire system connected to technical equipment of a factory or institution in conformity with a time table previously dialed on a sectorized dial plate of the Electric Dispatcher.

6 Claims, 13 Drawing Figures

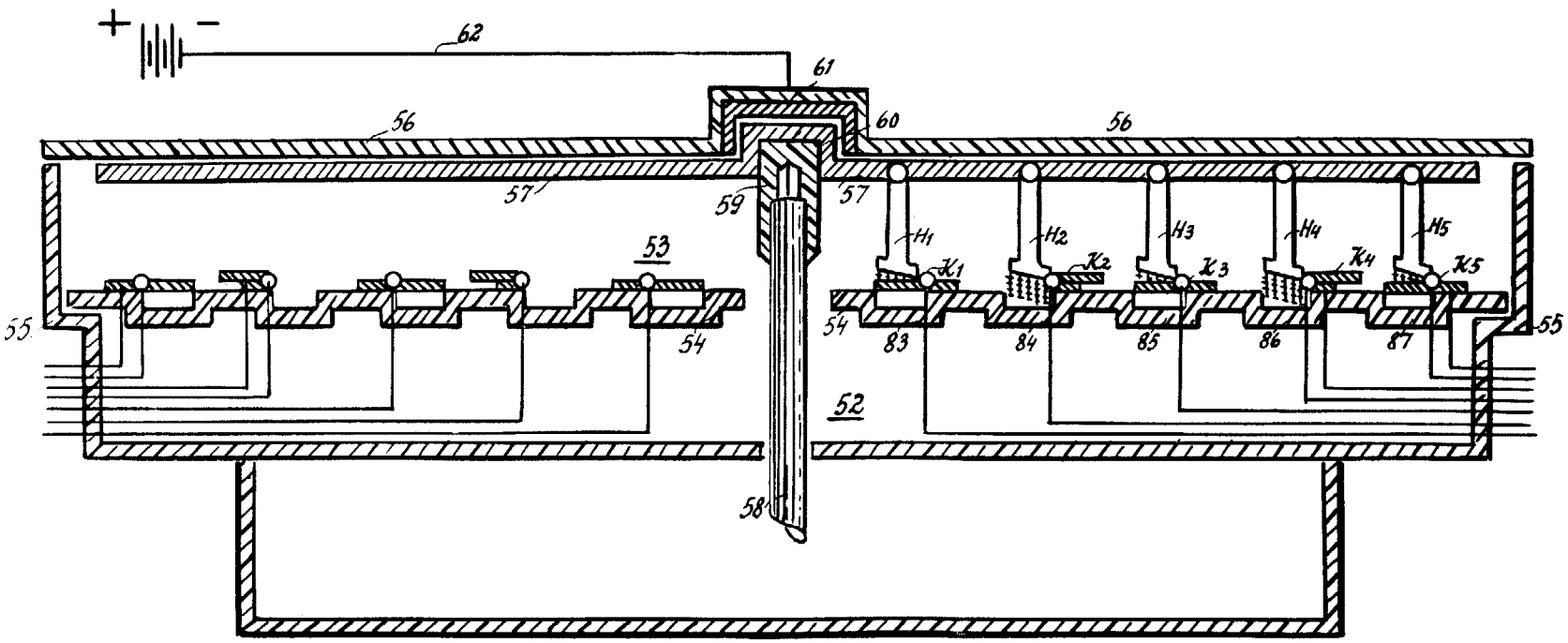
Фиг-7

Fig-8A.
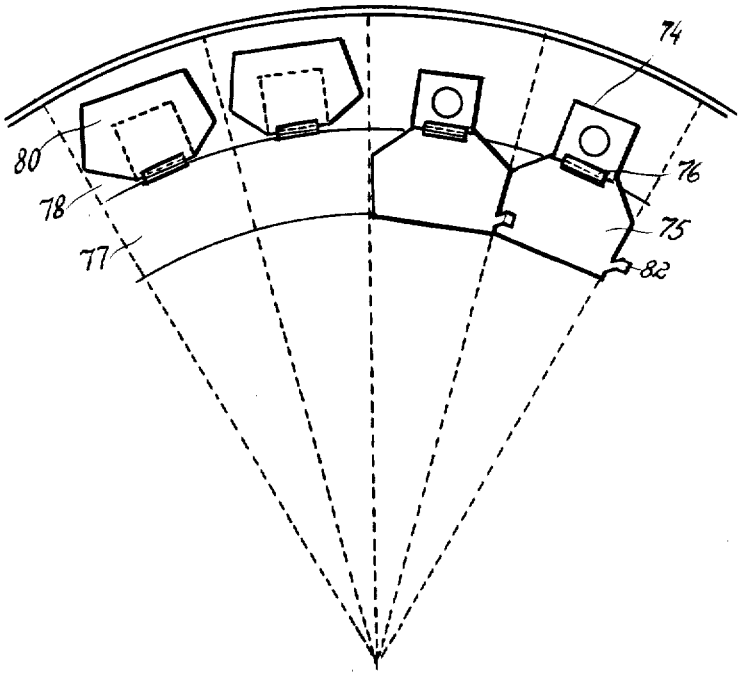
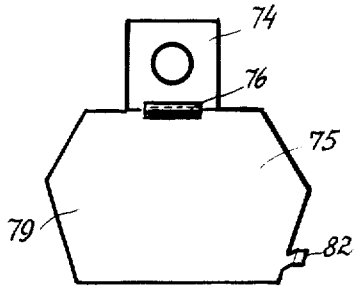
Fig-8B.

ELECTRIC DISPATCHERS

CROSS REFERENCE TO RELATED APPLICATIONS

This application is a continuation-in-part of abandoned application Ser. No. 925,986, filed July 19, 1978, which is a continuation of abandoned application Ser. No. 780,057, filed Mar. 22, 1977 both abandoned.

BACKGROUND OF THE INVENTION

The invention relates to an Electric Dispatcher switching system responsive to a time table of a factory, institution, laboratory, office or other institution. The switching system sets in motion and stops automatically a series of machines at predetermined times. Human interference is thereby eliminated. A considerable number of prior inventions have attempted to solve the problem of controlling one of more machines as technology has evolved. The Electric Dispatcher differs from prior art systems in the simplicity of structure and dial system, the exclusion of minute and second hands, the existance of numerous lines of connector means which permit simultaneous or consecutive control of electric devices or machines, the ability to provide a heavier electrical current through the Electric Dispatcher switching system, and the unlimited applications of the switching system.

SUMMARY OF THE INVENTION

The primary object of this invention is to provide an improved Electric Dispatcher switching system for the scheduling and controlling of machine functions in complex technical installations by the use of simple timing means. The Electric Dispatchers are essentially modified and perfected electric clocks comprising a superstructure contained within a modified clockbox.

Another objection of the invention is to provide an unique arrangement of connectors means which may be activated by a commutator arm having magnets or chain brushlets disposed on the arm.

A further object of the invention is the use of connector means which may be barred or unbarred. A barred connector means is a connector means which is retained in its non-operative position by some type of restraining structure such as a screw. An unbarred connector means is a connector means which may be activated mechanically through magnetic attraction or engaged by a brush-like element to complete an electric circuit or circuits within the Electric Dispatchers clockbox.

A still further object is to provide an improved Electrical Dispatcher having settable and resettable interruptors and connectors capable of carrying heavy loads of electric current.

Another object of this invention is the use of special electrical connector means which provide interruption or connection of preselected electric circuits within the clockbox. The preselected circuits conform to a time table previously dialed on an Electric Dispatcher sectorized dial plate. The special connector means are connected to the cables carrying electricity outside the Dispatcher box.

BRIEF DESCRIPTION OF THE DRAWINGS

FIG. 7 is an enlarged sectional view illustrating an Electrical Dispatcher commutator arm with glider means and five concentric circles of connector means actuating five electric displays.

FIG. 8A illustrates thee shape of the connector means in a representative sector of a concentric circle arrangement. Two connector means are shown in the unfolded position and two connector means are illustrated in the folded position.

FIG. 8B is an amplified top view of a single connector means in the unfolded position.

FIG. 11 illustrates the electric circuitry of an one-day Electric Dispatcher with glider means comprising five concentric circles of connector means actuating a plurality of machines or the like.

DESCRIPTION OF THE PREFERRED EMBODIMENTS

The actuating mechanism of an Electric Dispatcher is an electric clock means. The Electric Dispatchers or Electric Kaleidoscope may be a one-day dispatcher having a variable time period of 12–24 hours, an one-hour Dispatcher having 60 minutes function time, or a one-minute Dispatcher or Kaleidoscope having 60 seconds function time.

The Electric Kaleidoscopes are special Electric Dispatchers with magnets which operate and control automatically an one-minute program of luminous displays or luminous advertisement on buildings or special screens, or automatically control the function of electric devices or machines for the same period of time.

Divided in concentric segments of increasing size, the larger external sectors of the insulating plate can contain a bigger number of connector means so that divisions and subdivisions of time-units are obtained without special rotating and pointing means (clockhands) of the electric clock means.

Figure 4:
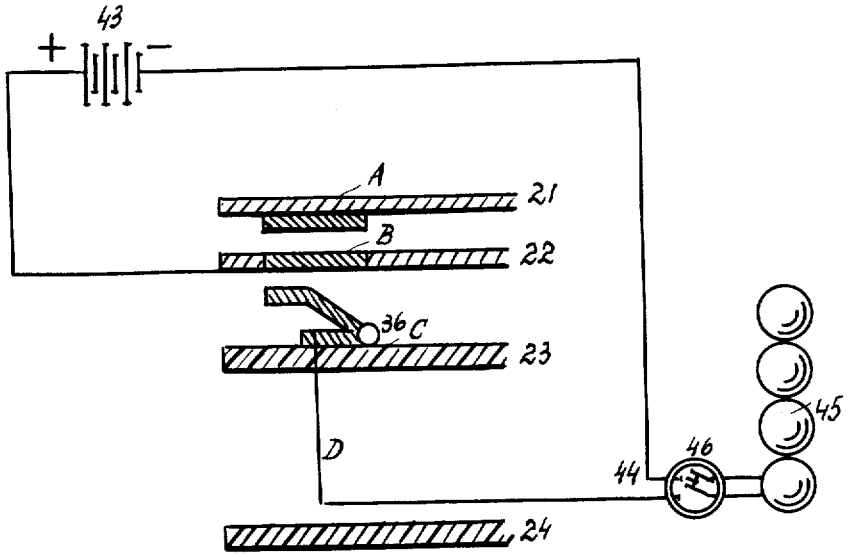
FIG. 4 illustrates the four levels of the inner housing electric circuitry taken about line 4 of FIG. 1.
Figure 6:
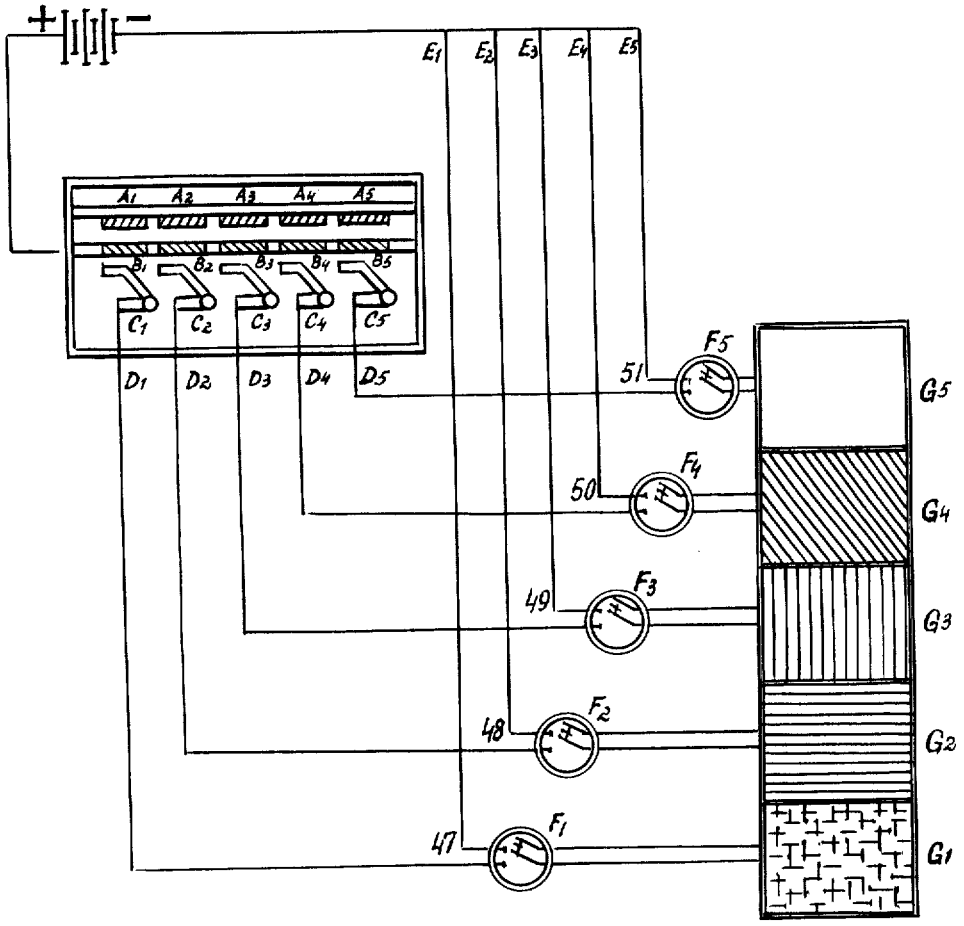
FIG. 6 illustrates Electric Kaleidoscope circuitry including five concentric circles of connector means actuating five electric displays.

The Electrical Kaleidoscope comprises an electric clock means 20 which automatically controls the function of numerous electric appliances or machines, a commutator arm 21 with magnets A1–A5, an electric grate means 22 consisting of five concentric metal rings united by radial bars noting sector 2B, an upper cylindric plate 23 sectorized into time units supporting the system of connector means C1–C5, a lower cylindric plate 24 with radial compartments containing the electric wires D1–D7 descending from the upper plate, the compartments having lateral outlets for the electric wires, a modified clock box housing means 25 with two ledges 26,27 supporting the cylindric plates 23,24 and a disc 28 which covers the Electric Kaleidoscope, and a source of power 43 as shown in FIGS. 4 and 6.

Figure 2:
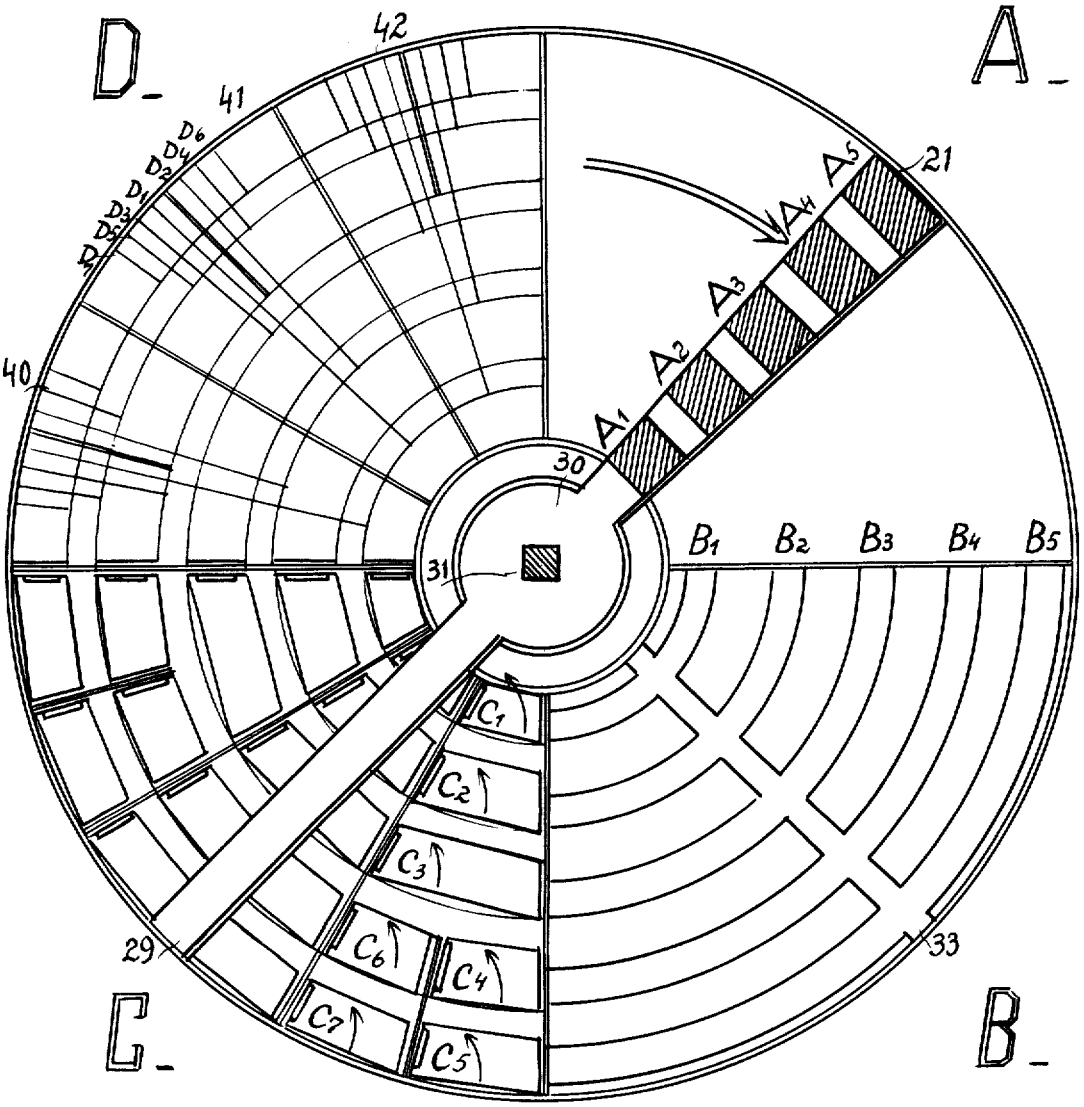
FIG. 2 illustrates four sectors of 90 degrees, each sector representing a separate level of an Electric Kaleidoscope. Sector 2A illustrates the shape of an commutator arm with magnets. Sector 2B illustrates a quadrant of the electric grate beneath the commutator arm. Sector 2C represents a 90 degree sector of connector means situated under the electric grate. Sector 2D illustrates a quadrant of the wire compartment.

The commutator arm 21 illustrated in sector A of FIG. 2 has the shape of a 3 to 5 degrees sector. The length of its diameter is approximately the length of the dial plate. The arm is composed of non-magnetizable material. Rectangular part 29, which is part of the commutator arm 21, noting sector 2C of FIG. 2, serves as an equipoise in order to create an equilibrium of weight between the two halves of the commutator arm and facilitate or enhance the commutator arm rotation. The center of the commutator arm has the shape of a disc 30 with a square or rectangular cavity 31 in the middle of the disc. A square or rectangular top of a clockshaft 32 is disposed within the cavity 31 to securely mount the commutator arm to the clockshaft. At least five magnets A1–A5 are secured to the undersurface or bottom of the commutator arm by use of screws or other types of fastener structure. The magnets are designed to be of adequate size and sufficient magnetic force to attract preselected connector means parts into engagement with the grate means.

Electric grate means 22, consisting of five concentric copper or aluminum rings B1–B5 united by radial bars 33 noting sector 2B of FIG. 2, rests on the upper ledge 26 of the Dispatcher housing means 25 directly beneath the commutator arm 21. The electric grate means is connected to one pole or terminal of a source of electricity as illustrated in FIGS. 4 and 6.

Figure 1:
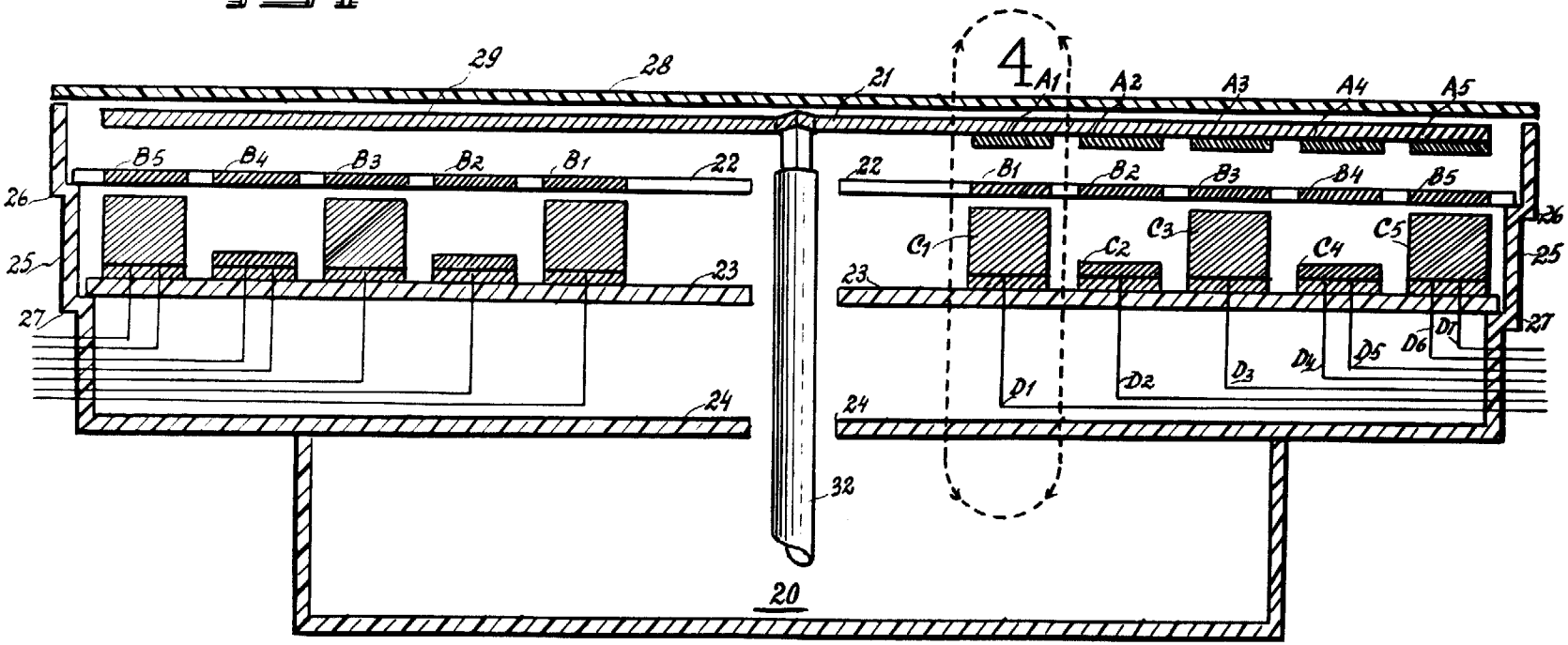
FIG. 1 illustrates a transversal sectional view of an Electric Dispatcher or Kaleidoscope with permanent magnets comprising five concentric circles of connecting means.
Figure 5:
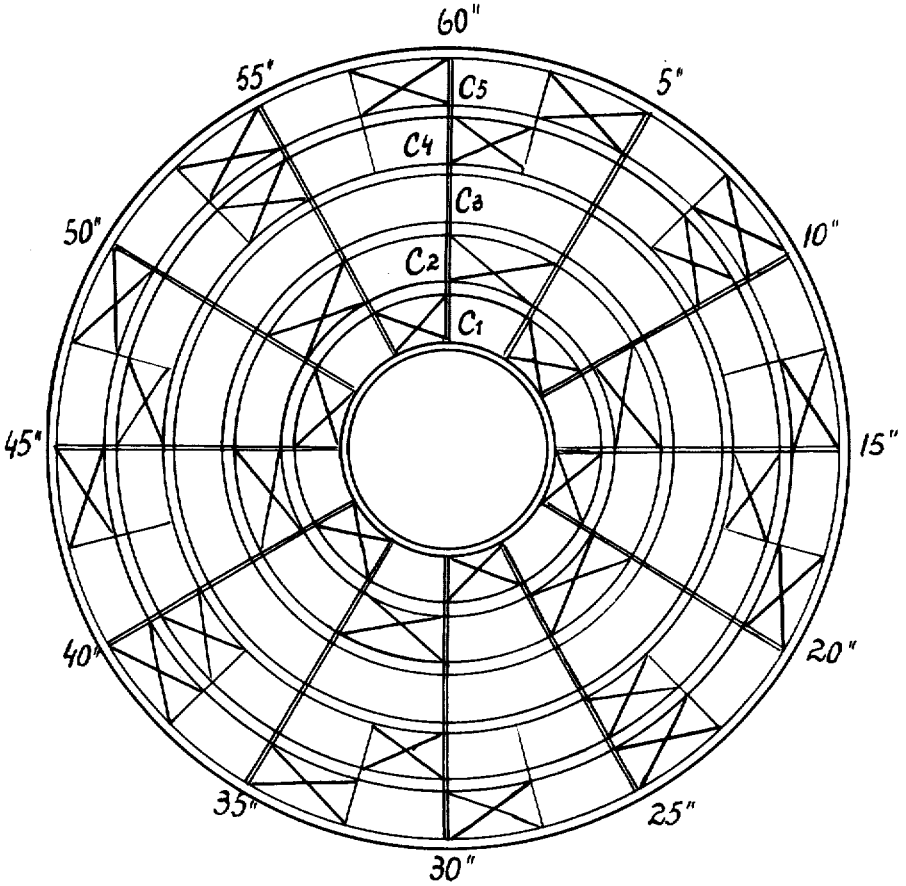
FIG. 5 illustrates a representative Electric Kaleidoscope dialing system comprising five concentric circles of connector means.

A circular plate of insulating material 23 lies on the lower ledge 27 of the Dispatcher housing means 25. The plate supports five concentric circles of connector means C1–C5. The magnets, grate rings and corresponding connector means are superposed in vertical lines. The connector means are screwed or otherwise fixed to the insulating plate 23 having their hinges being set on radial lines, with the opening angles directed towards the rotating commutator arm 21 as shown in sector 2C of FIG. 2. The internal three circles of connector means C1–C3 have the size of their 30 degree sectors and correspond to five seconds dial time. The two external sectors are divided and have the size of 15 degrees corresponding to 2½ seconds dial time. If the Electric Kaleidoscope is large, other circles of magnets, grate rings and connector means can be added. Shorter divisions of time can be obtained. As shown in FIGS. 1 and 5, the connector means C2 and C4 are barred; however, the connector means C1, C3, C5 are unbarred in the working position and are dialed or preset in conformity with a previously established time table.

Figure 3A:
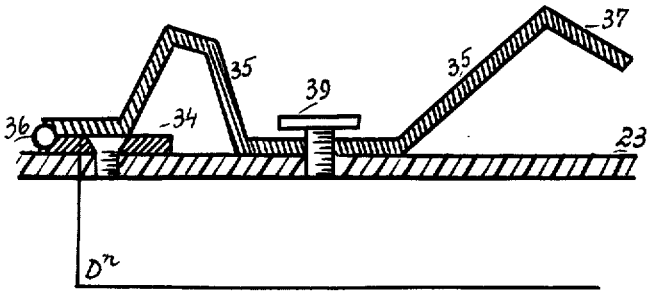
FIG. 3A illustrates a transversal view of a connector means embodiment and FIG. 3B shows the Kaleidoscope connector means in a pictorial view in the barred position.
Figure 3B:
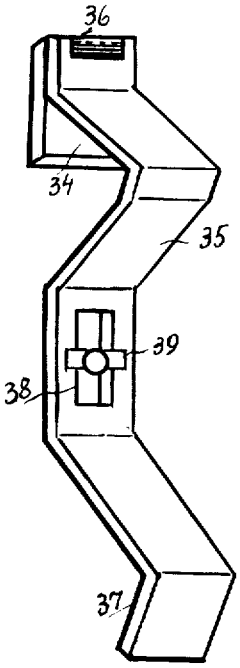

The connector means illustrated in FIGS. 3A and 3B have a rectangular shape and consist of two parts. The immovable part 34 is screwed or otherwise fixed to the underlying insulating plate 23. The movable part 35 is attached to the immovable part by a hinge 36, lies reversed on its hinge over the immovable part 34, and is bent downwardly in its middle to contact the underlying plate 23. The movable part is bent at its free end 37 forming an angle of about 100–120 degrees to insure tight contact engagement with the electric grate means 22. A rectangular cavity 38 in the middle portion of the movable part contains a screw having a rectangular head. The lower end of the screw is disposed in the underlying plate 23, and immobilizes the connector means movable part if the screw head is turned to a position as shown in FIG. 3B and rectangular head 39 is vertical to the length side of the rectangular cavity 38.

As shown in sector 2D of FIG. 2, the lower level of the Electric Dispatcher with magnets of Electric Kaleidoscope is divided in sector-type compartments such as compartments 40,41 and 42. Within the compartments, electric wires are welded to the immovable part of each connector means. The electric wires descend through perforations in the insulating plate into their respective compartments. There are seven electric wires D1–D7 which correspond to the number of connector means noting the 30 degree arcuate portion of sector D in FIG. 2.

FIG. 4 illustrates the connecting system noting the corresponding sectorized structure within line 4 of FIG. 1. Positive electric current flows from a source of power 43 through wire D into ring B of the electric grate means 22. The rotating commutator arm 21 has a magnet A which attracts the unbarred movable part 35 of the connector means C, which in turn, is lifted to the level of grate ring B producing a tight contact engagement so that electricity flows through connector means C and wire Dn meets wire Dx carrying negative electricity to allow activation of the electric light bulb displays 45 in FIG. 4. A double pole switch 46 set in the electric circuit allows the electric bulb display 45 to be turned on or off. If the connector means is barred, the circuit remains interrupted.

FIG. 5 illustrates schematically the time table and the dialing system of an Electric Kaleidoscope with five concentric circles of connector means. Each circle is associated with a distinct luminous display of a particular color. In this instance, circles C1–C5 are associated with the colors yellow, blue, red, green and plain electric white, respectively. The connector means of circle C3 are unbarred for the whole cycle while the connector means of circles C1 and C2, respectively, are alternately barred and unbarred for five seconds. The two external circles are subdivided into periods of 2½ seconds. The connector means of circle C4 have regularly barred intervals of 2½ seconds after 5 seconds of working time. The connector means of circle C5 have regularly barred and unbarred periods of 2½ seconds. FIG. 5 illustrates also the time table of luminous displays or luminous advertising, if special displays are planned instead of colors.

FIG. 6 presents the diagram of the electric circuitry of an Electric Kaleidoscope with five circles of connector means C1–C5 for five colors or other luminous displays. Positive electric current flows from a source of power 43 into the electric grate rings B1–B5. The rotating commutator arm with its magnets A1–A5 reaches the radial lines of the connector means at the same time and lifts the unbarred connector means C1–C5 to the level of the electric grate rings. The electric wires D1–D5 conduct the electric current outside the Kaleidoscope box where the wires join electric wires E1–E5 at points 47–51 carrying negative electricity. Double pole switches F1–F5 are used to turn on and off the lights of the luminous panel displays designated as G1–G5 for yellow, blue, red, green and plain electric white, respectively.

In order to dial an Electric Kaleidoscope, the following procedure is used. The Kaleidoscope will be disconnected from its source of power. The covering disc is removed. The commutator arm and the electric grate means are lifted. The connector means which are not desired to work in the one minute time table will be barred. The Electric Kaleidoscope is designed to automate endlessly or for a predetermined time the repetition of an one minute luminous advertising display as described above or similar luminous displays in five colors. The Electric Kaleidoscope can also be used to automate the function of other devices or machines. Furthermore, the above described Electric Kaleidoscope with magnets can be applied to one hour or one day Electric Kaleidoscopes.

The position of any Electric Kaleidoscope or Electric Dispatcher must be in the horizontal plane.

The Electric Dispatchers with commutator arm and glider means, as shown in FIG. 7, have an upper level 53 containing the commutator arm 57, slider means H and the connector means K. A lower level 52 contains the wire compartments. A cylindrical plate of insulating material 54 supporting the connector means K1–K5 has channels 83–87 disposed within the lower level compartment. The plate 54 lies on a ledge of the housing box and a disc of insulating material 56 is used as a cover for the Electric Dispatcher.

The commutator arm 57 of this system is the distributor of electricity and has a triple function. The arm transmits the rotating movement of the clockshaft 58, receives electric current and distributes the electric current through glider means H1–H5 to the connector means K1–K5. As a result, the technical equipment of a factory or institution is controlled in conformity to the predetermined time table on sectorized dial plate 54 of the Electric Dispatcher.

Figure 9:
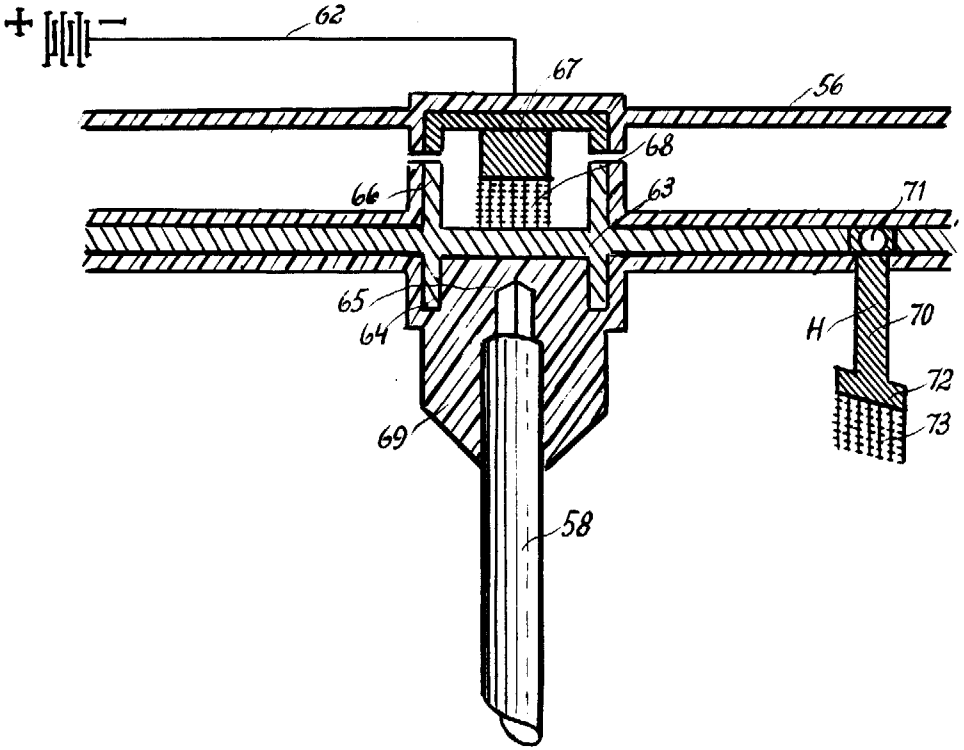
FIG. 9 is a transversal sectional view of the cylindrical portion of the commutator arm, means for connecting the commutator arm glider means to an electrical source of energy, details of the cover and attachment of the clockshaft 58 to the commutator arm.

As shown in FIG. 7 and FIG. 9, the commutator arm 57 consists of two parts. One part supports the slider means H1–H5 and the other part functions as an equipoise to facilitate or enhance the rotating movement of the commutator arm. The equipoise extends beyond the center of the clockshaft 58 or commutator arm 57 and is diametrically opposed to the first commutator arm part. In FIG. 7, the center of the commutator arm 57 supports a cylindrical copper or aluminum button 60 which is positioned within the cavity of a reversed copper or aluminum cylinder 61 fixedly mounted in the insulative covering disc 56. The cylinder 61 is connected to an external source of power 88 by cable 62.

An alternative embodiment of the commutator arm 57 is shown in FIG. 9. The arm is supported by a double hollow cylinder 63. The lower cylinder part 64 has a square or rectangular cavity within an insulative part 69 designed to fasten the commutator arm on clockshaft 58. The clockshaft top has, consequently, the same square or rectangular shape. The upper part of the double cylinder 63 is open and contains a brush device within the upper cylindrical cavity. The brush device consists of a metal panel 67 fixed in the covering disc 56 and is connected to a source of power 88 by cable 62. The lower end of the metal panel 67 supports a brushlet of copper chainlets 68 designed to transmit electricity to the rotating commutator arm 56. The insulating cylindrical part 69 encloses tightly the clockshaft 58.

The commutator arm 57 supports as many glider means H, noting FIG. 9, corresponding in equal number of the circles of connector means. The glider means H in FIG. 9 consists of a metal rod 70 whose enlarged top 71 is screwed or otherwise fixed to the commutator arm. The lower enlarged part 72 of the glider means 70 supports a little brush 73 consisting of copper chainlets. The brush 73 is oriented at an oblique position with respect to a radial line in each respective connector means circle. This structural arrangement allows the brush to bridge adjacent working connector means and avoid a break in the continuity of the preselected working connector means pattern if consecutive connector means have been folded into their respective working positions.

The length of the chainlet brush 73 is greater than the distance between the glider means H and the connector means K in the working position thereby insuring a positive contact engagement between the connector means and the chainlet brush 73. This structural relationship is illustrated in FIG. 7. Note the flat circular plate 54 of the Electrical Dispatcher which has five channels 83–87 which are deep enough to avoid electrical contact of the glider means chainlet brush 73 with the connector means K2 and K4 disposed in the non-working position. The brush chainlets associated with the glider means H1,H3 and H5 engage the preset working connector means K1, K3 and K5.

The connector means K1–K5, belonging to the Electric Dispatchers with glider means H, consist of two parts. A smaller immovable part 74 is screwed to the bottom plate 53. A movable part 75 is attached to the immovable part 74 by a hinge 76. In FIG. 8A, the movable patt 75 is illustrated in its non-working position 80.

A little metal flap 82, noting FIG. 8B, is welded with the lower corner of the movable part 75 of a connector means or an extension thereof. The metal flap 82 is designed to cover an adjacent connector means in a fish scale configuration to avoid a break in the flow of electric current. If the connector means are unfolded in their working position 79, as illustrated in FIG. 8B, the chainlet brushes 73 of the rotating gliders slide over the connector means. The desired electric circuit or circuits are completed and electric power is transmitted to a system of electric appliances or machines. FIG. 7 illustrates the connector means K1, K3 and K5 unfolded in their respective working positions. The connector means K2,K4 are folded over their immovable parts in non-working positions.

Figure 10:
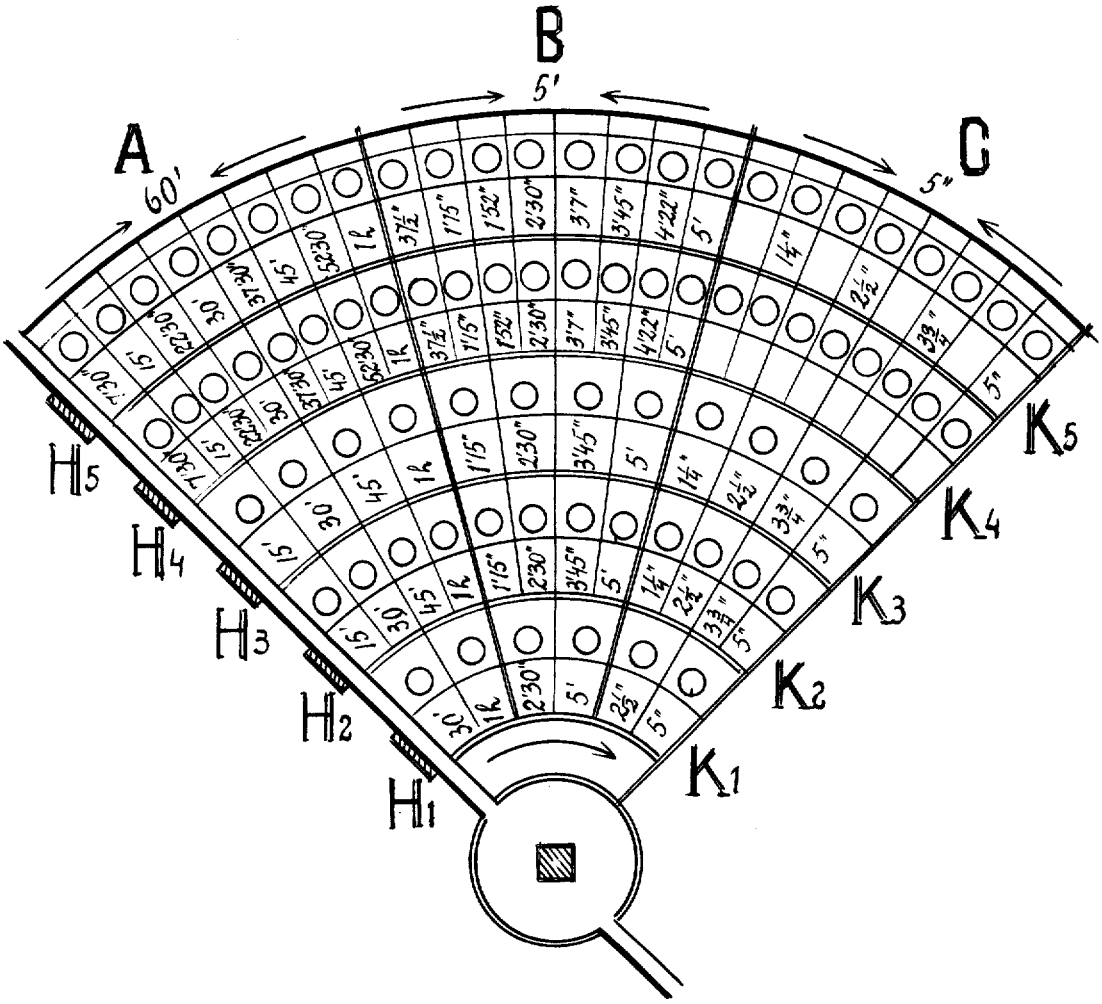
FIG. 10 illustrates three sectors of Electrical Dispatcher timing structures having glider means. Sector 10A illustrates the possible divisions of an one hour sector, Sector 10B illustrates the possible divisions of a five-minutes sector. Sector 10C shows the possible divisions of a five seconds sector.

FIG. 10 illustrates three sectors A,B and C which are representative of different types of Dispatcher dials for one day, one hour and one minute Electrical Dispatchers. Each sector A-C of FIG. 10 has an arcuate span of 30 degrees. The connector means have approximately one centimeter unfolded space, one centimeter folding space and one-half centimeter safety space.

Sector A of FIG. 10 contains connector means in circle K1 of 15 degrees and represents a dial time of 30 minutes. The sectors of circles K2 and K3 within the arcuate sector A have individual connector means spanning a distance of 7½ degrees with a corresponding dial time of 15 minutes. The sectors of circles K4 and K5 have connector means whose arcuate span in 3 degrees and 45 minutes which represents a dial time of 7½ minutes.

Sector B of FIG. 10 represents a typical 30 degree sector of an one hour Electric Dispatcher. The connector means of circle K1 are 15 degrees in arcuate length and represent a dial time of 2½ minutes. The connector means of circle K5 span an arcuate distance of 3 and ¾ degrees. The corresponding dial time is 37½ seconds.

In sector C of FIG. 10, which represents a 30 degree sector of an one minute Electrical Dispatcher, the connector means of circles K1 and K5 have a dial time of 2½ seconds and ⅝ seconds, respectively. The arcuate span length of the connector means of circle K1 is 15 degrees.

Another system of dial division could translate degrees into minutes and seconds. One degree of an one day (12 hours) Electric Dispatcher represents 2 minutes dial time. One degree of an one hour Electrical Dispatcher represents 1/6 minute or 10 seconds. One degree of an one minute Electric Dispatcher represents 1/6 second.

Figure 11:
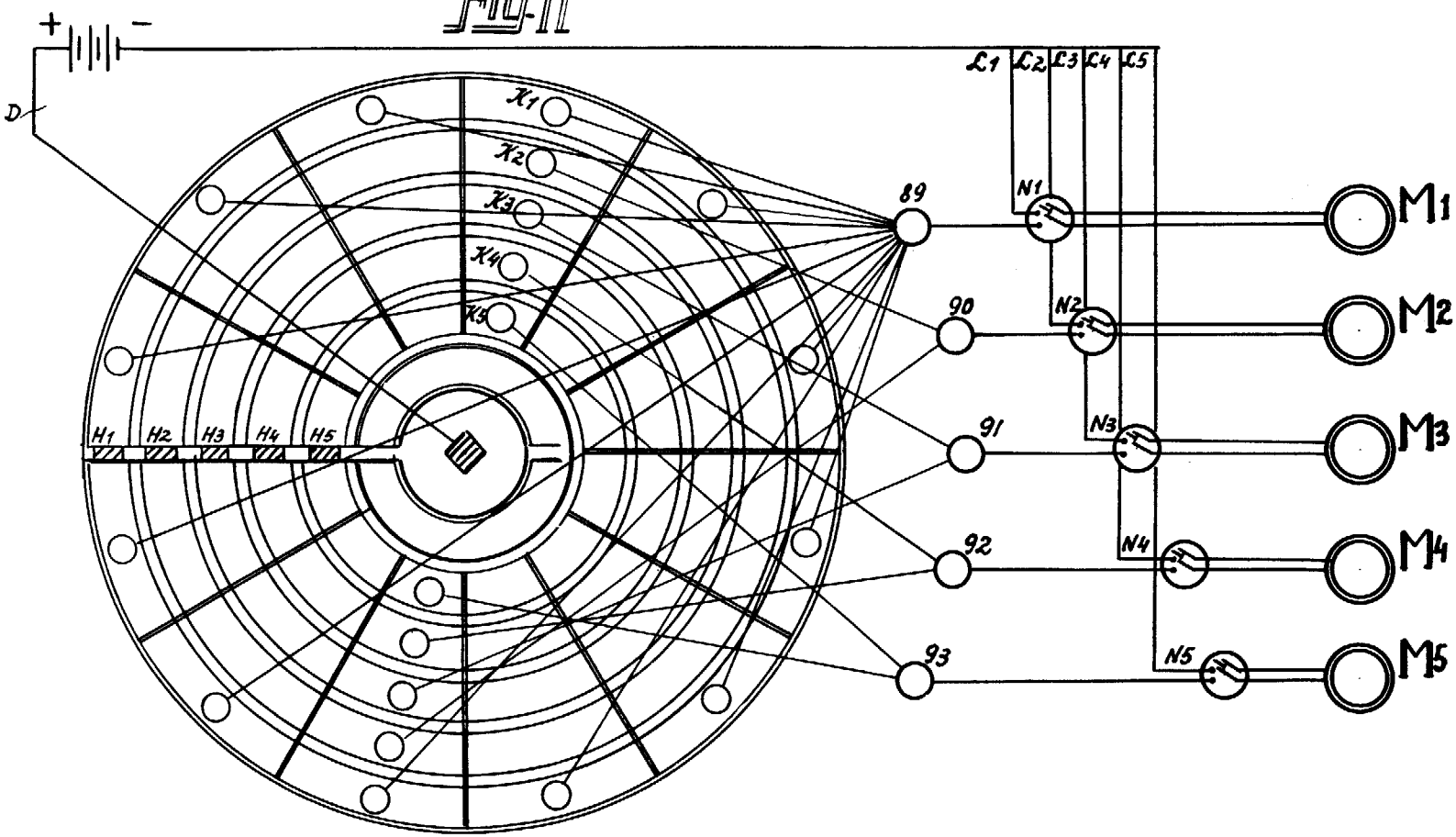

FIG. 11 illustrates the circuitry of an one day Electric Dispatcher. Positive electric current flows from a power source 88 into commutator arm 57 and further into the glider means H1–H5. The connector means K1–K5 are energized when set in the working position by engagement of the chainlets attached to the glider means. The electric wires of the connector means are welded or otherwise connected with the main cables at points 89–93 and meet the electric wires L1–L5, carrying negative electricity. The main cables are connected to double pole switches N1–N5 and electric wires L1–L5. The double pole switches N1–N5 are used to turn on or off the electric machines M1–M5.

In order to dial an Electric Dispatcher with a time table previously established, the Electrical Dispatcher is disconnected from its source of electricity. The covering disc and commutator arm are subsequently removed. The connector means remain unfolded or if they are not designed to work, the movable parts of the connector means are reversed over their immovable parts. Five circles of connector means are able to automate and control the function of five machines working simultaneously or consecutively. Furthermore, any number of machines can be controlled, working at limited times, dependent upon the number of connector means, concentric circles and other critical design factors.

The electric wires should have different colors for each circle of connector means. The movable parts of the connector means should have printed indicia or the like on the upper surface illustrating their function time.

Since various improvements could be made in my invention herein described, it is obvious that all matter contained within the specification will be interpreted as illustrative only and not limited in any sense.

I claim:

1. An Electric Dispatcher or Electric Kaleidoscope switching assembly with magnets for controlling the timing of one minute luminous advertising, luminous displays or other electrically actuated apparatus, the settable and resettable one minute switching system comprising:

a source of electric energy, a programmable electric clock means for connecting said source to the displays and for controlling the operation of the displays or of other electrically actuated apparatus, the programmable electric clock means further comprising:

(a) a housing means having a clock box compartment and electric program timing connector means compartments disposed in three levels, (b) said electric program timing connector means compartments having two ledges on said housing means, (c) a rotatable commutator arm connector activating means detachably mounted to a clockshaft above an electric grate means, (d) an electric grate means connected to said source of energy supported by the upper ledge of the housing means and consisting of concentric metal rings united by transversal bars, and a sectorized time unit cylindrical plate supporting connector timing means, (e) said connector timing means mounted in concentric circles on said sectorized time unit plate, said connector timing means consisting of an unmovable part screwed to the underlying plate, and a movable part attached by a hinge to the unmovable part and lying reversed over the unmovable part, (f) rotation of said rotatable commutator arm connector activating means across any sector of the concentric circles of connector means causing the energizing of unbarred electrical connector means with said grate means, thereby activating desired displays or the like.

2. An one-minute Electric Kaliedoscope switching system as in claim 1, wherein the timing connector means are selectively barred or unbarred by the rotation of a screw with rectangular head fixed in the underlying sectorized time unit plate in a rectangular cavity in said movabe connector means.

3. An one-minute Electric Kaleidoscope switching system as in claim 1, wherein the rotatable commutator arm connector activating means has magnets attracting unbarred electrical connector timing means disposed in concentric circles on said cylindrical time unit plate in order to contact the electrical grate means and thereby connect the source of energy to the displays or the like.

4. One-day, one-hour or one-minute Electric Dispatcher switching assemblies with glider means and connector timing means for controlling the simultaneous or consecutive operation of the technical equipment of factories or institutions, the Electric Dispatchers being activated by one-day, one-hour or one-minute electric clock means, the Electric Dispatchers switching system comprising:

a source of electric energy, a programmable electric clock means for connecting said source to the technical equipment of factories of institutions and for controlling the simultaneous or consecutive operation of said equipment, the programmable electric clock means further comprising:

(a) a housing means having a clockbox compartment and an electric program timing connector means compartment, (b) the electric program timing connector means compartment having one ledge on the housing means, (c) a sectorized time unit cylindrical plate mounted on said ledge supporting concentric circles of connector timing means, (d) a rotatable commutator arm detachably mounted to the clockshaft of the electrical clock means, said rotatable commutator arm being connected to said source of electric energy, said rotatable commutator arm having glider means with chainlet brushes designed to slide above the circles of unfolded connector timing means to energize said connector timing means, (e) said connector timing means consisting of an immovable part screwed to the underlying sectorized time unit plate and a foldable movable part, attended by a hinge to the immovable part, (f) rotation of said rotatable commutator arm with glider means across any sector of the concentric circles of connector timing means causing the energizing of the unfolded electrical connector timing means.

5. An Electric Dispatcher switching system as in claim 4, wherein the connector timing means are selectively folded or unfolded.

6. An Electric Dispatcher switching system as in claim 4, wherein the rotatable commutator arm having glider means mounted thereto and sliding over selectively unfolded connector timing means disposed in concentric circles on the sectorized cylindrical time unit plate electrically connects said slider means and said unfolded connector timing means with said source of energy, thereby activating the technical equipment of factories or the like in conformity with the time table previously established.

* * * * *